US008763399B2

(12) United States Patent
Dodo et al.

(10) Patent No.: US 8,763,399 B2
(45) Date of Patent: Jul. 1, 2014

(54) COMBUSTOR HAVING MODIFIED SPACING OF AIR BLOWHOLES IN AN AIR BLOWHOLE PLATE

(75) Inventors: Satoshi Dodo, Kasama (JP); Hiromi Koizumi, Hitachi (JP); Keisuke Miura, Mito (JP); Hirokazu Takahashi, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 1100 days.

(21) Appl. No.: 12/751,503

(22) Filed: Mar. 31, 2010

(65) Prior Publication Data

US 2010/0251725 A1 Oct. 7, 2010

(30) Foreign Application Priority Data

Apr. 3, 2009 (JP) ..... 2009-090629

(51) Int. Cl.
*F23R 3/30* (2006.01)

(52) U.S. Cl.
USPC ..... 60/737; 60/740; 431/181

(58) Field of Classification Search
USPC ..... 60/737, 740, 746, 748; 431/181, 182, 431/185, 187
See application file for complete search history.

(56) References Cited

U.S. PATENT DOCUMENTS

| | | | | |
|---|---|---|---|---|
| 5,129,231 | A * | 7/1992 | Becker et al. | 60/754 |
| 5,307,637 | A * | 5/1994 | Stickles et al. | 60/756 |
| 5,321,951 | A * | 6/1994 | Falls et al. | 60/748 |
| 5,509,270 | A * | 4/1996 | Pearce et al. | 60/740 |
| 5,956,955 | A * | 9/1999 | Schmid | 60/748 |
| 6,751,961 | B2 * | 6/2004 | Pacheco-Tougas et al. | 60/752 |
| 6,755,024 | B1 | 6/2004 | Mao et al. | |
| 6,978,618 | B2 * | 12/2005 | Pacheco-Tougas et al. | 60/752 |
| 7,260,936 | B2 * | 8/2007 | Patel et al. | 60/752 |
| 7,328,582 | B2 * | 2/2008 | Sandelis et al. | 60/804 |
| 7,506,512 | B2 * | 3/2009 | Schumacher et al. | 60/754 |
| 7,509,813 | B2 * | 3/2009 | Stastny | 60/804 |
| 8,006,499 | B2 * | 8/2011 | Koganezawa et al. | 60/775 |
| 8,424,311 | B2 * | 4/2013 | York et al. | 60/737 |
| 2004/0011054 | A1 | 1/2004 | Inoue et al. | |
| 2008/0053103 | A1 * | 3/2008 | Stastny | 60/782 |
| 2008/0066468 | A1 * | 3/2008 | Faulder et al. | 60/737 |
| 2009/0223227 | A1 * | 9/2009 | Lipinski et al. | 60/746 |
| 2010/0071378 | A1 * | 3/2010 | Ryan | 60/748 |
| 2010/0186413 | A1 * | 7/2010 | Lacy et al. | 60/740 |

FOREIGN PATENT DOCUMENTS

| | | | |
|---|---|---|---|
| CN | 1157563 | C | 7/2004 |
| JP | 2003-148734 | A | 5/2003 |

OTHER PUBLICATIONS

English translation of Original of Second Notification of Reasons for Refusal dated Aug. 31, 2012 (four (4) pages).

* cited by examiner

*Primary Examiner* — Phutthiwat Wongwian
*Assistant Examiner* — Michael B Mantyla
(74) *Attorney, Agent, or Firm* — Crowell & Moring LLP

(57) ABSTRACT

A combustor includes a fueling nozzle that jets a fuel towards a combustion chamber located downstream and a flat-plate-shaped air blowhole plate that faces the upstream side of the combustion chamber and that is disposed between the fueling nozzle and the combustion chamber. The air blowhole plate has a plurality of air blowholes arranged at equal intervals in a circumferential direction relative to the center of the air blowhole plate, in order to jet a flow of fuel and a flow of air that is formed at the outer circumferential side of the fuel flow toward the combustion chamber.

10 Claims, 16 Drawing Sheets

COMBUSTOR HAVING MODIFIED SPACING OF AIR BLOWHOLES IN AN AIR BLOWHOLE PLATE

BACKGROUND OF THE INVENTION

1. Field of the Invention

The present invention relates to a combustor and a method for modifying the same.

2. Description of the Related Art

Power-generating plants that support industrial electric power services include gas turbine power-generating plants fueled by a natural gas, petroleum, or other fossil resources. Since the gas turbine power-generating plants fueled by fossil resources release the carbon dioxide ($CO_2$) that is a global warming material, these power plants are being required to improve power-generating efficiency more significantly than ever before. Ways to improve power-generating efficiency include increasing the temperature of the combustion gases released from the gas turbine combustor. However, as the combustion gas temperature is increased, nitrogen oxides (NOx) that are an environmental pollutant contained in the combustion gases will increase exponentially. It is therefore becoming a technically crucial challenge how to reduce NOx while enhancing power-generating efficiency.

Operational cases of the gas turbine power-generating plants powered by a hydrogen-containing fuel such as the coke-oven gas occurring in a coke oven during iron-and-steel making processes are also increasing in recent years from the perspective of global-warming prevention and control. In addition to the coke-oven gas, examples of hydrogen-containing fuels include a by-product gas called the blow-off gas occurring in an oil purification process, and a coal gasification gas that is used at integrated gasification combined cycle (IGCC) power-generating plants. Because of its wide combustible range and its high combustion rate, the hydrogen contained in the fuel may form high-temperature flames near the walls of the combustor, deteriorating combustor reliability. In order to prevent local formation of high-temperature flames, it is effective to disperse the fuel and burn the fuel uniformly in the entire combustor.

JP-2003-148734-A, therefore, discloses a technique for disposing an air blowhole plate between a fueling nozzle and combustion chamber in a combustor, forming a fuel flow and an air flow at the outer circumferential side of the fuel flow, inside air blowholes provided in the air blowhole plate, and jetting the fuel flow and the air flow into the combustion chamber. The combustor described in JP-2003-148734-A is constructed so that NOx can be reduced by enhancing dispersibility of the fuel with respect to the air.

SUMMARY OF THE INVENTION

The air blowhole plate described in JP-2003-148734-A has air blowhole exits on the plate surface directed towards the combustion chamber, the air blowhole exits being arranged at equal intervals in a circumferential direction relative to a central region of the air blowhole plate. Use of a fuel containing hydrogen, however, accelerates combustion rate, thus increases a flame temperature. Near a position at which the flame abuts a wall surface of the combustor, therefore, the combustor wall surface has tended to increase in temperature, and the combustor itself has therefore been subject to deterioration in reliability. In addition, a region in which a plurality of flames abut each other is deformed by mutual contact between the adjacent flames. This, in turn, has tended to cause pressure fluctuations or the like, resulting in deteriorated combustor reliability.

An object of the present invention is to maintain combustor reliability.

An aspect of the present invention includes a plurality of burners operable independently of one another, and a circumferential array of air blowholes; wherein a spacing between air blowholes that are part of the circumferentially arrayed air blowholes, in a phase that a flow of fuel and a flow of air reach an inner wall of a combustion chamber after being jetted from the circumferentially arrayed air blowholes, or in a phase that the fuel flow and the air flow interfere with two adjacent burners, is greater than in other phases of the air blowholes.

According to the present invention, combustor reliability can be maintained.

DESCRIPTION OF THE PREFERRED EMBODIMENTS

Embodiments of the present invention will be described hereunder.

First Embodiment

Figure 4:
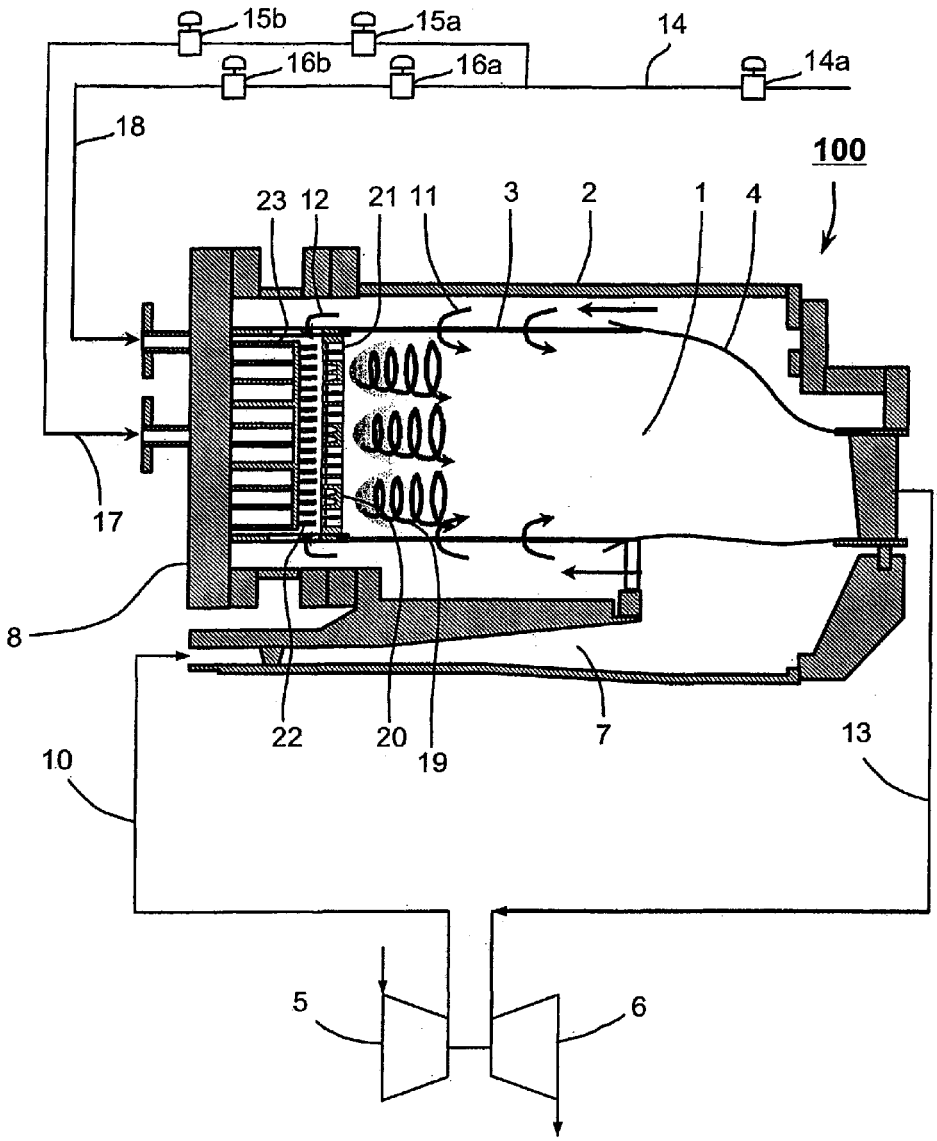
FIG. 4 is a schematic block diagram of a gas turbine system employing the combustor in the first embodiment.

FIG. 4 is a schematic block diagram of a gas turbine system employing a combustor 100 of a first embodiment.

Compressed air 10 that has been generated by a compressor 5 flows into a casing 7 of the combustor 100.

In addition to a combustor liner 3 provided for the combustor 100 to combust a fuel-air mixture 19 internally to the combustor liner 3 in a combustor outer casing 2, the combustor 100 includes a combustion chamber 1 formed internally to the combustor liner 3. The compressed air 10, after being supplied from the compressor 5, passes through a space between the combustor outer casing 2 and the combustor liner 3. Part of the compressed air 10 then becomes cooling air 11 to cool the combustor liner 3. A remainder of the compressed air 10 enters a space between a combustor end cover 8 and an air blowhole plate 20, as combusting air 12.

Meanwhile, fuel 14 flows from the outside of the combustor end cover 8 into a fuel distributor 23, and then the fuel 14 is jetted from a fueling nozzle 22 disposed near an upstream end of the air blowhole plate 20. The combustor 100 shown and described in the present embodiment also has a plurality of burners operable independently of one another. The burners can be classified into a pilot burner positioned particularly in a central section of the combustor and operated as a starting section from a start of ignition, and outer circumferential burners that undertake loaded operation, in particular. A starting fuel 17 supplied to the pilot burner is controlled to a predetermined flow rate via a fuel pressure control valve 15*a* and a fuel flow control valve 15*b* before being supplied to the combustor 100. An outer-circumferential burner fuel 18 supplied to the outer circumferential burners is controlled to a predetermined flow rate via a fuel pressure control valve 16*a* and a fuel flow control valve 16*b* before being supplied to the combustor 100. The air blowhole plate 20 includes a plurality of air blowholes 21 arranged at equal intervals in a circumferential direction relative to a central axis of the air blowhole plate. The fuel flow and air flow that have jetted from the air blowholes 21 form a flame in the combustion chamber 1. After this, a combustion gas 13 flows through a combustor transition piece 4, then flows into a turbine 6, and thus drives an electric power generator or the like.

Figure 3:
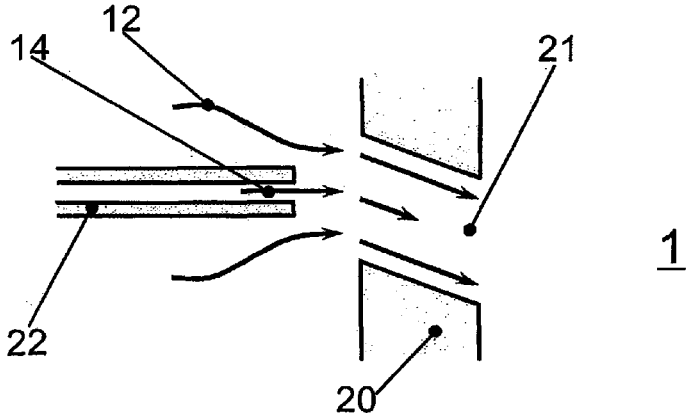
FIG. 3 is an enlarged view of a fueling nozzle end.

FIG. 3 is an enlarged view of an end of the fueling nozzle 22. The air blowhole plate 20 of a flat-plate shape is disposed between the fueling nozzle 22 and the combustion chamber 1. The compressed air 10 from the compressor 5 is introduced into a position that is further upstream relative to the upstream end of the air blowhole plate 20. The fueling nozzle 22 is disposed at an upstream side of the air blowholes 21, so that the fuel flow 14 that has jetted from the fueling nozzle 22 flows into the air blowholes 21. The combusting air 12 supplied from the upstream side of the air blowhole plate 20, also flows from an outer circumferential side of the fueling nozzle 22 into the air blowholes 21. At this time, the combusting air 12 flows from a wide space formed at the upstream side of the air blowhole plate 20, into the air blowholes 21 that are each a narrower space. Inside the air blowholes 21, therefore, the fuel flow and an annular flow of air formed at an outer circumferential side of the fuel flow are considered to flow towards the combustion chamber 1. At this time, the fuel flow and air flow that have passed through the air blowholes 21 are jetted in bursts towards the combustion chamber 1, a wider space than the air blowholes 21, thereby to mix with each other in the combustion chamber 1 rapidly.

In this arrangement with the plurality of air blowholes in the air blowhole plate and the fueling nozzle at the upstream side of the air blowholes, the fuel that has flown into the combustion chamber rapidly disperses, which in turn increases a degree of mixing of the fuel and air, thus achieving rapid mixing within a minimum time. In this arrangement, the fuel flow moves centrally inside the air blowholes and the air flow moves around the fuel flow, such that a fuel-air mixture in a combustible range is not formed in immediate vicinity of the fueling nozzle. In addition, progress of mixing in a very narrow region of the air blowholes suppresses entry of the combustion gas thereinto, and hence, flashback.

The air blowholes 21 in the above-described positional relationship between the fueling nozzle and the air blowholes have a central axis inclined in a circumferential direction of the air blowhole plate 20. The fuel flow and air flow that jet from the air blowholes 21, therefore, are injected into the combustion chamber 1, along the central axis of each air blowhole 21. Since the air blowholes 21 are thus inclined in the circumferential direction of the air blowhole plate 20, the fuel flow and air flow that have been jetted from the air blowholes 21 become a swirling flow inside the combustion chamber 1 to move towards a downstream side while helically swirling.

Figure 2:
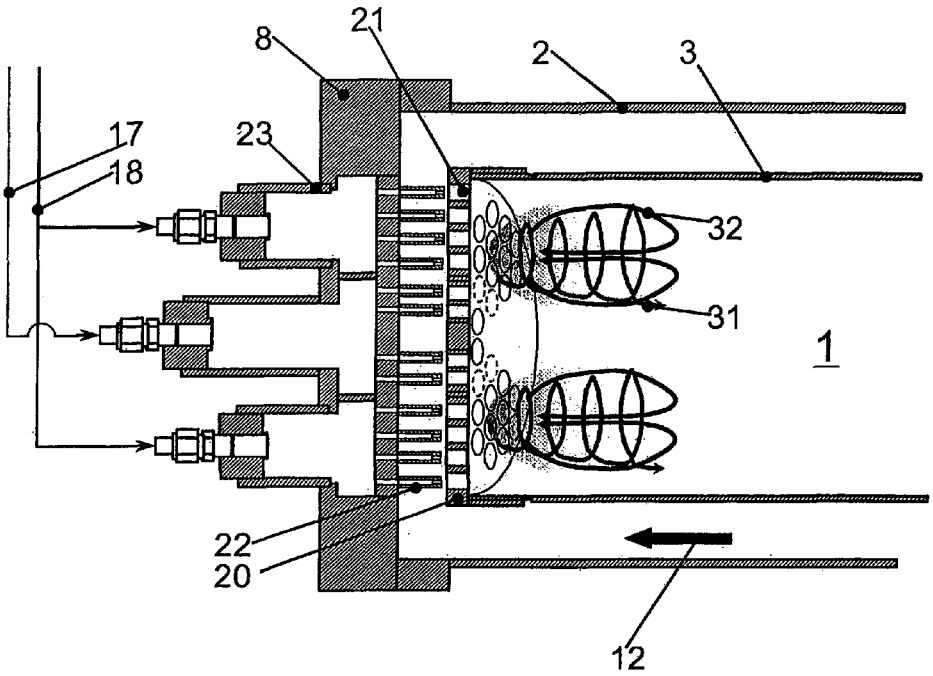
FIG. 2 is a diagram that shows a schematic structure of a combustor according to the first embodiment, and directions in which a fuel and air will flow inside the combustor.

FIG. 2 shows a schematic structure of the combustor 100 and the directions in which the fuel flow and the air flow move inside the combustor. In the present embodiment, the swirling flow 31 that has jetted from the air blowhole plate 20 increases in swirling radius while helically swirling. The increase in swirling radius creates an inverse pressure gradient region to reduce pressure progressively from the downstream side to the upstream side, centrally in the combustion chamber. This results in part of the combusted mixture flowing in reverse as a circulating flow 32 towards the air blowhole plate. When heat of the hot combustion gas conveyed by the circulating flow 32 is used to provide activation energy to the mixture supplied from the air blowholes, a combustion reaction will be maintained and a conical flame formed in the combustor.

As described above, the combustor 100 illustrated in the present embodiment has seven burners that can be operated independently of one another. The burners can be classified into a pilot burner positioned in a central section of the combustor and activated particularly as a pilot burner from a start of ignition, and six outer circumferential burners that undertake loaded operation, in particular.

Figure 1A:
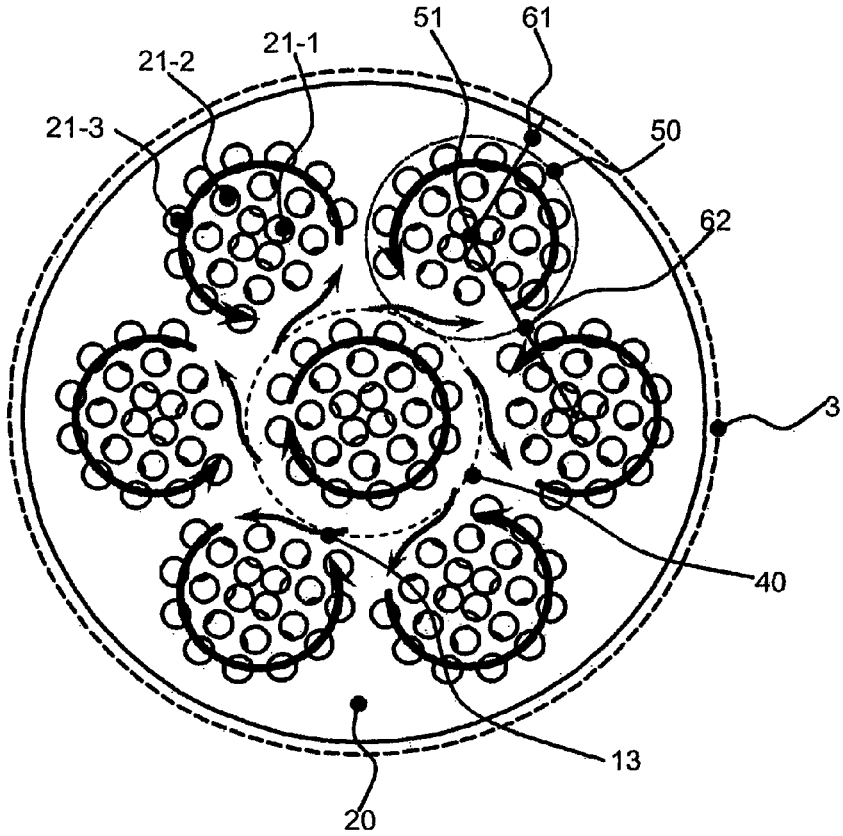
FIGS. 1A and 1B are structural diagrams showing an air blowhole plate used in a first embodiment.
Figure 1B:
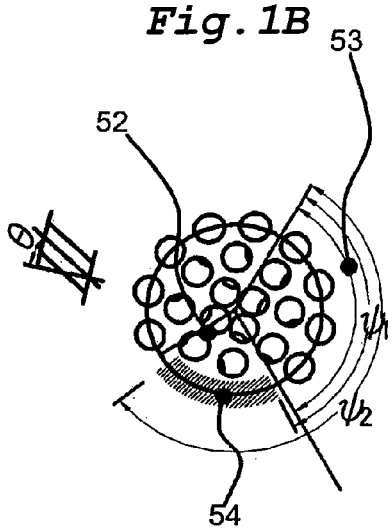

FIGS. 1A and 1B are structural diagrams of the air blowhole plate 20, FIG. 1A showing the air blowhole plate 20 existing when viewed from the combustion chamber 1, and FIG. 1B focusing upon one of the outer circumferential burners in the air blowhole plate 20. In the air blowhole plate 20, air blowholes 21 corresponding to the pilot burner 40 are provided at a central section encircled with a broken line in FIG. 1A. The air blowholes 21 in the pilot burner 40 are each assigned a swirling angle so that a fuel-to-air mixture jetted from each air blowhole will swirl clockwise when viewed from the combustion chamber. The swirling angle θ assigned to the air blowhole is an angle formed by a central axis of the air blowhole and a tangent on the circumference where the air blowhole is disposed.

In addition, air blowholes 21 corresponding to the six outer circumferential burners 50 are provided around the pilot burner 40. The air blowholes in each outer circumferential burner 50 are constituted by three air blowhole arrays each having the same pitch circle. A first air-blowhole array 21-1, a second air-blowhole array 21-2, and a third air-blowhole array 21-3 are each assigned a swirling angle so that the fuel-to-air mixture jetted from the air blowholes will swirl counterclockwise when viewed from the combustion chamber.

The air blowholes described above will also hold even if they are non-circular blowholes (e.g., rectangular slots).

A position of the combustor liner 3 with respect to the air blowhole plate 20, located at a downstream external side of the plate, is shown as an outer broken line in FIG. 1A. In addition, in FIG. 1B, the air blowholes in each outer circumferential burner 50 are constituted by three air blowhole arrays each having the same pitch circle. A first air-blowhole array 21-1 and a second air-blowhole array 21-2 are arranged at equal intervals circumferentially relative to the center of the air blowhole plate 20. However, a third air-blowhole array 21-3, disposed in the outermost circumferential region, on a circumference of a third pitch circle with a radius 52, does not have an air blowhole in an interference avoidance section 54. The interference avoidance section 54 refers to a range from a phase in which the mixture jetting from air blowholes in the burner first reaches the combustor wall, to a position at which the mixture jetting from the air blowholes starts to interfere with a mixture jetting from an adjacent burner. The spacing between the air blowholes defined in the interference avoidance section 54 is therefore wider than the spacing between the air blowholes of the other arrays.

Since each burner operates so that, as described above, the fuel-air mixture jet flow from the air blowhole plate 20 expands while helically swirling to form a conical flame, the interference avoidance section 54 exists in a phase chronologically retroactive from the position where adjacent burners face the combustor liner 3, in the swirling direction (i.e., clockwise). By having the interference avoidance section 54, therefore, each outer circumferential burner 50 constitutes such a third air blowhole array as notched towards the pilot burner 40. That is to say, a difference in spacing is provided between the air blowholes of each third array.

In a region neighboring the air blowhole plate 20, part of the combustion gas 13 of the flame from the pilot burner 40 flows in from the notched section of the third air blowhole array, towards the region of the outer circumferential burner. The outer circumferential burner 50 creates a swirl inverse to that of the pilot burner 40, so that the combustion gas 13 that has flown into the outer circumferential burner region is further entrained by the swirling flow that the outer circumferential burner 50 itself has created. The heat of the combustion gas from the pilot burner 40 then joins the mixture jet flow from the outer circumferential burner. Thus, combustion stability of the outer circumferential burner 50 is strengthened and reliability of the combustor is maintained. Additionally, in particular, when the outer circumferential burner 50 is ignited, effective delivery of the combustion gas from the pilot burner 40 to the outer circumferential burner 50 occurs to improve flame propagation.

Figure 5:
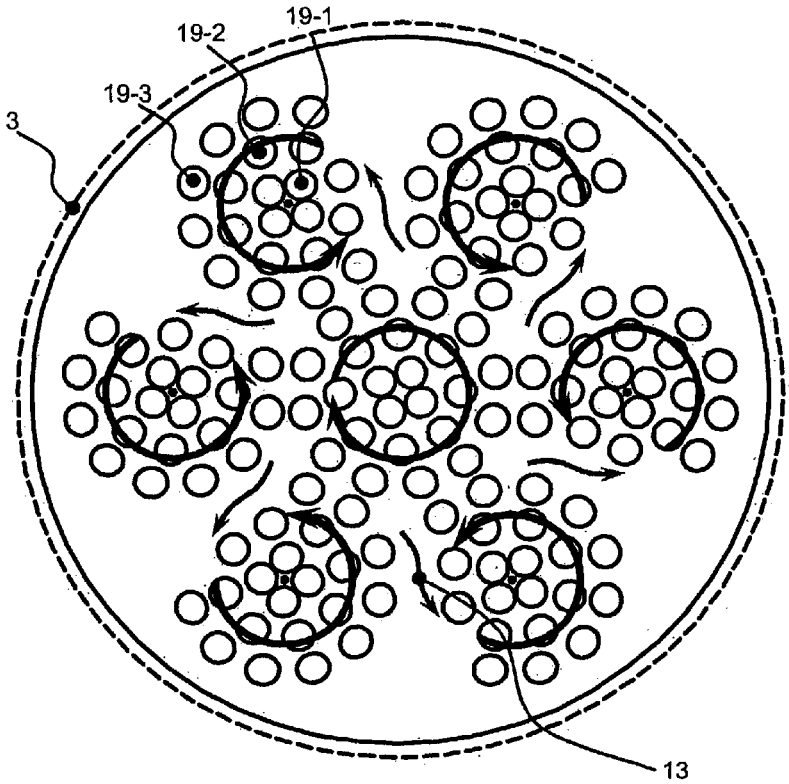
FIG. 5 is a diagram that shows fuel-air mixture jet flow positions corresponding to axial combustor positions at which flames from adjacent outer circumferential burners abut each other in the first embodiment.

FIG. 5 shows the fuel-air mixture jet flows from air blowholes 21, as viewed from the downstream direction at the combustor axial downstream position where the flames from the adjacent outer circumferential burners 50 abut each other. As described above, the jet flows of the fuel-air mixture from air blowholes 21 expand in swirling radius while helically swirling to form a conical flame. Therefore, at the axial downstream position of the combustor where the flames from the adjacent outer circumferential burners 50 abut each other, the jet flow of the mixture from the pilot burner swirls clockwise and the jet flows of the mixture from the outer circumferential burners swirl counterclockwise.

For this reason, in a region neighboring the air blowhole plate 20, the interference avoidance section 54 exists between the pilot burner 40 and each outer circumferential burner. At the combustor axial downstream position where the flames from adjacent outer circumferential burners 50 abut each other, a region equivalent to the interference avoidance section 54, that is, a region without a mixture jet flow is positioned in a space between two any outer circumferential burners. This prevents the flames from the outer circumferential burners 50 from interfering with each other.

Next, a case in which, despite there being an interference avoidance section, a mixture jet flow is present also in a region equivalent to the interference avoidance section of the present embodiment, will be studied as a first comparative example. In this comparative example, in the space between the outer circumferential burners 50, a mixture with a velocity component, heading from the direction of the combustor liner 3 towards the center of the combustor, and a mixture from an adjacent burner, heading from the combustor center towards the combustor liner 3, draw close to each other with a significant difference in velocity component, thus causing strong shear.

Strong shear on the flame deforms the flame surface and increases a surface area of the flame. The increase in surface area may, in turn, increase an apparent combustion rate, abruptly causing unusual heat, and leading to pressure fluctuations. In addition, if the shear becomes even stronger, the combustion rate will be unable to catch up with an increase in surface area due to the deformation of the flame surface, and the flame will get quenched. Combustion will then repeat alternating between the abrupt generation of heat and the extinction, and thus lead to significant fluctuations in pressure.

In particular, if the fuel contains hydrogen, since the fuel originally is high in combustion rate and wide in combustible range, a limit at which the flame becomes quenched will be elevated even under a significantly shear-deformed state of the flame, and if the pressure significantly fluctuates, this is most likely to result in great significant pressure fluctuations. In the case that the fuel contains hydrogen, therefore, it is important to minimize shear in a region with actively occurring combustion reactions. Providing the interference avoidance section 54 leads to preventing mixture jet flows with oppositely oriented velocity components from interfering with each other in the space between adjacent burners, and thus to preventing significant shear from occurring.

Additionally, combustion stability improves since the combustion gas 13 from the pilot burner flows into a region equivalent to the interference avoidance section 54, that is, a region without a mixture jet flow.

Figure 6:
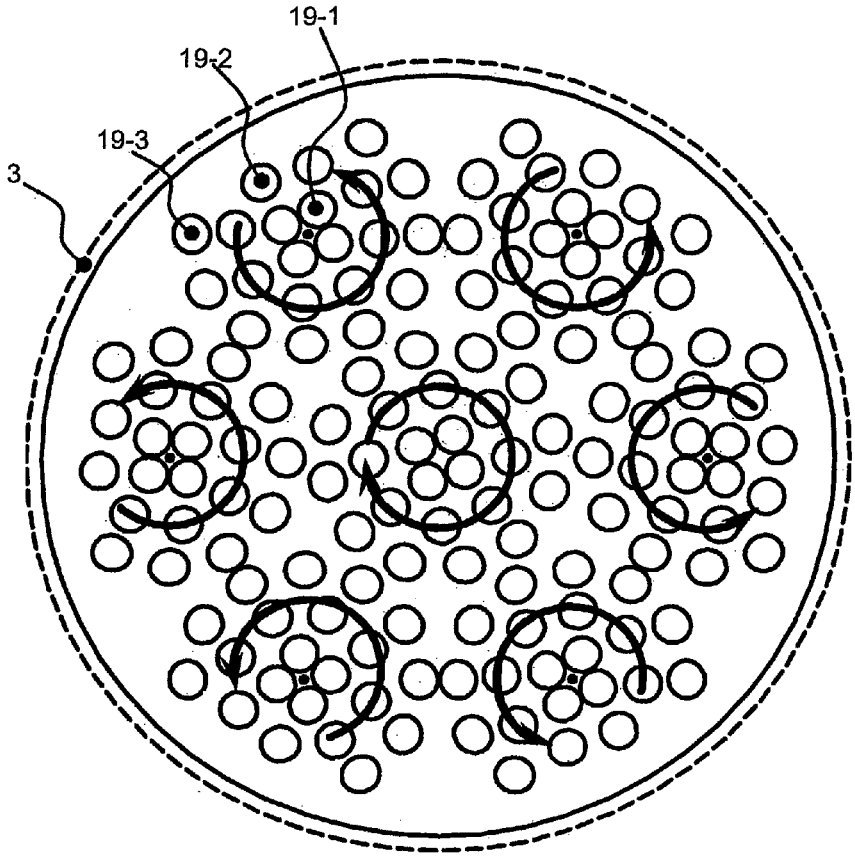
FIG. 6 is a diagram that shows fuel-air mixture jet flow positions corresponding to axial combustor positions at which the flames from the outer circumferential burners abut a combustor liner in the first embodiment.

FIG. 6 shows the fuel-air mixture jet flows from air blowholes 21, as viewed from the downstream direction at the combustor axial downstream position where the flames from the outer circumferential burners 50 abut the combustor liner 3. As described above, the jet flows of the fuel-air mixture from air blowholes 21 expand in swirling radius while helically swirling to form a conical flame. Therefore, at the axial downstream position of the combustor where the flames from the outer circumferential burners 50 abut the combustor liner 3, the jet flow of the mixture from the pilot burner swirls clockwise and the jet flows of the mixture from the outer circumferential burners swirl counterclockwise.

For this reason, at the position of the air blowhole plate 20, the interference avoidance section 54 exists between the pilot burner 40 and each outer circumferential burner. At the combustor axial downstream position where the flames from the outer circumferential burners 50 abut the combustor liner 3, a region equivalent to the interference avoidance section 54, that is, a region without a mixture jet flow is positioned to face the combustor liner 3. This prevents creation of local high-temperature sections due to interference of high-temperature flames with the combustor wall surface.

In a second comparative example that is a case in which, despite there being an interference avoidance section, a mixture jet flow is present also in a region equivalent to the interference avoidance section of the present embodiment, flames are blown directly onto the combustor liner 3 to create locally high-temperature sections. In particular, if the fuel contains hydrogen, since hydrogen has a very short extinction length and permits flames to approach up to a region immediately proximate to metallic walls, as well as accelerating combustion at a high rate, the combustion gas generated will be very hot. Accordingly, if the flames come into direct contact with the combustor liner 3, increases in liner wall surface temperature will be very significant in comparison with those observed during use of other fuels. In the case that the fuel contains hydrogen, therefore, it is important that in a region with actively occurring combustion reactions, the flames should not come into direct contact with the combustor liner 3. Providing the interference avoidance section 54 leads to preventing the flames from coming into direct contact with the combustor liner 3, and thus to preventing a local high-temperature region from occurring at the combustor liner 3.

The phases in which the interference avoidance section is provided in FIGS. 1A and 1B, are described below. Let a distance 61 from a central section 51 of one outer circumferential burner 50 to an internal surface of the combustor liner 3 be defined as $L_1$, and a linear distance 62 from the central section 51 of the outer circumferential burner 50 to that of an adjacent outer circumferential burner 50, as $L_2$. Also, express the radius 52 of the pitch circle of the third air blowhole array in the outer circumferential burner 50 as "r", and an angle 53 formed between a perpendicular line drawn from the central section 51 of the outer circumferential burner 50 to the inner surface of the combustor liner 3, and a straight line extending from the central section 51 of the outer circumferential burner 50 to that of the adjacent outer circumferential burner 50, as $\alpha$. A starting position of the angle is taken on the perpendicular line from the central section 51 of the outer circumferential burner 50 to the inner surface of the combustor liner 3, increases of the angle are defined in a direction tracing the swirling direction (in the present embodiment, clockwise), and the angle is expressed using a unit in which a full circle takes an angle of 360°. Furthermore, the swirling angle to be given to the third air blowhole array is defined as θ°, and a diameter of the air blowholes of the third array is defined as "d".

A phase angle ψ1 at which the mixture jetting from the air blowholes reaches the combustor wall surface for the first time can be approximated using the following expression:

$$\psi_1 \approx \frac{\theta}{(0.035\theta + 0.25)} \times \left[ -3.70\left\{\frac{\left(L_1 - \frac{d}{2}\right)}{r}\right\}^2 + 12.1\left\{\frac{\left(L_1 - \frac{d}{2}\right)}{r}\right\} - 7.81 \right] \quad \text{Expression (1)}$$

Also, a phase angle ψ2 at which the mixture jetting from the air blowholes interferes with a mixture jetting from an adjacent burner can be approximated using the following expression:

$$\psi_2 \approx \alpha + \frac{\theta}{(0.035\theta + 0.25)} \times \left[ -3.70\left\{\frac{(L_2 + d)}{2r}\right\}^2 + 12.1\left\{\frac{(L_2 + d)}{2r}\right\} - 7.81 \right] \quad \text{Expression (2)}$$

A phase region equivalent to the phase angles ranging between the ψ1 and ψ2 values obtained using expressions (1) and (2) can be defined as the interference avoidance section 54. Depending upon the number of air blowholes and/or a pitch of the angles, the interference avoidance section 54 may have its starting position ψ1 and ending position ψ2 slightly shifted. The effects obtained, however, will be substantially the same.

While the outer circumferential burners each having three arrays of air blowholes have been focused in the description of the first embodiment, substantially the same effects can be obtained by adopting the above arrangement in a second array of a two-array configuration or in the outermost array of a configuration with four arrays or more.

If an existing combustor has an air blowhole plate shaped like a flat plate, the effects of the present embodiment can likewise be obtained by replacing the particular air blowhole plate with that of the embodiment.

Second Embodiment

Figure 7:
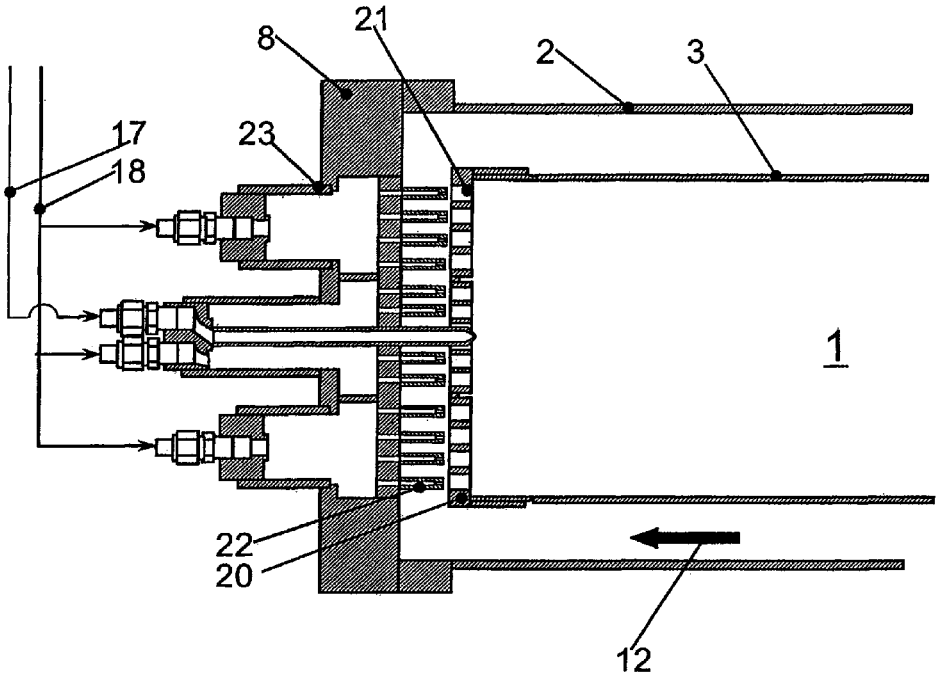
FIG. 7 is a schematic structural diagram of a combustor in a second embodiment.

FIG. 7 is a schematic structural diagram of a combustor 100 in a second embodiment, also showing a direction in which a fuel and air will flow inside the combustor. Structural differences from the first embodiment are described below. One structural difference is that since an oil fuel is used as a starting fuel 17, an injection nozzle for the oil fuel is provided centrally in a pilot burner. Another structural difference from the first embodiment is that a burner using an outer-circumferential burner fuel 18 is disposed around the oil fuel injection nozzle, in which structure, a section including both the burner and nozzle combined is the pilot burner. For a fuel that contains hydrogen, if firing fails during a start of a gas turbine, the fuel discharged in an unburned condition is likely to combust in a device located downstream. For safety purposes, therefore, a fuel that does not contain hydrogen may be used to fire the combustor and activate the turbine in up to a midway stage of its starting process, and the fuel may be replaced with a hydrogen-containing one in appropriate timing during the starting process. The present embodiment is a combustor adapted to the cases described above.

Figure 8A:
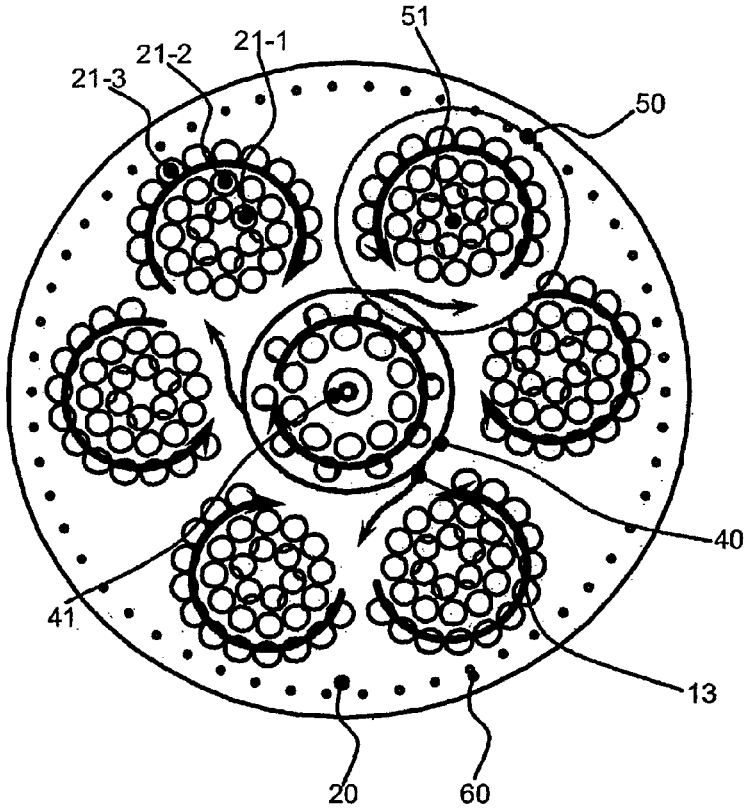
FIG. 8 is a structural diagram showing an air blowhole plate used in the second embodiment.
Figure 8B:
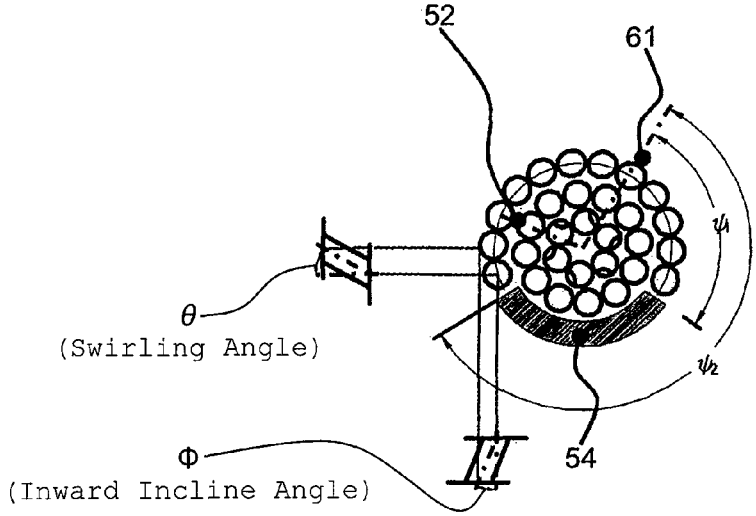

FIGS. 8A and 8B are front views of an air blowhole plate 20 in the second embodiment, the plate 20 being as viewed from a direction of a combustion chamber. Structural differences from the first embodiment are described below. One structural difference is that as described above, an oil fuel injection nozzle 41 for a starting fuel 17 is provided centrally in the air blowhole plate 20 and surrounded with air blowholes 21 for a pilot burner using an outer-circumferential burner fuel 18. The air blowholes of the pilot burner, as in the first embodiment, are each assigned a swirling angle so that a fuel-air mixture jetting from the air blowholes will swirl clockwise.

Three of six outer circumferential burners 50 each have air blowholes assigned a swirling angle so that a fuel-air mixture jetting from the air blowholes will swirl counterclockwise. The remaining three outer circumferential burners 50 each have air blowholes assigned a swirling angle so that a fuel-air mixture jetting from the air blowholes will swirl clockwise. Another structural difference from the first embodiment is that the outer circumferential burners 50 that swirl mixtures counterclockwise, and the outer circumferential burners 50 that swirl mixtures clockwise are arranged at alternate positions.

A further structural difference from the first embodiment is that the air blowholes 21 in each outer circumferential burner 50 are assigned an inward inclination angle $\phi$ incline in an inward direction towards a central section 51 of the outer circumferential burner, as well as being assigned the swirling angle $\theta$.

Furthermore, cooling air holes 60 for protecting a combustor liner 3 are arranged externally to the outer circumferential burners 50.

Compared with the first embodiment, the second embodiment has the following effects. Firstly, combustion stability improves under the alternate layout of the two sets of outer circumferential burners 50 that generate the swirls heading in directions opposite to each other. Velocity components of the fuel-air mixture jet flows from the air blowholes head in the same direction in a space between adjacent outer circumferential burners 50, so the adjacent outer circumferential burners do not cause interference between respective flames. On the contrary, the adjacent burners strengthen each other's swirling mixtures for improved combustion stability.

Secondly, since the outer circumferential burners 50 that generate the swirls heading in the directions opposite to each other are arranged at alternate positions, an interference avoidance section 54 in each outer circumferential burner 50 is disposed to communicate between two outer circumferential burners 50, the communication making it easier for a combustion gas 13 from the pilot burner 40 to flow into a region of the outer circumferential burners 50. Additionally, at both sides of the interference avoidance section 54 which has communicated, a flow heading from a direction of the combustor central axis, towards the combustor liner 3, exists to strengthen an effect of drawing in the combustion gas 13 from the pilot burner 40. The amount of heat from the pilot burner 40 is thus delivered to the outer circumferential burners 50 more actively. This, in turn, improves flame transferability and combustion stability.

Thirdly, since the air blowholes 21 in each outer circumferential burner 50 are assigned the inward inclination angle $\phi$, as well as the swirling angle $\theta$, to incline in the inward direction towards the central section 51 of the outer circumferential burner, the jet flow of the fuel-air mixture from the air blowholes 21 helically swirls while scaling down in swirling radius, and then re-expands. Because of the mixture flowing in this way, the flame formed will have a small radius at the air blowhole plate side, compared with the radius in the first embodiment, and at the same time, the scaling-up of the flame radius will be slow. Accordingly, at where the flame of the outer circumferential burner 50 comes into contact with the combustor liner 3, the flame will move to a downstream side. This will increase an allowance for combustor liner cooling in a neighboring region of the air blowholes that has active combustion reactions, and will thus facilitate cooling.

Phases in which the interference avoidance section is provided in FIGS. 8A and 8B, are described below. As in FIGS. 1A and 1B, let a distance 61 from a central section 51 of one outer circumferential burner 50 to an internal surface of the combustor liner 3 be defined as $L_1$, and a linear distance 62 from the central section 51 of the outer circumferential burner 50 to that of an adjacent outer circumferential burner 50, as $L_2$. Also, express a radius 52 of a pitch circle of a third air blowhole array in the outer circumferential burner 50 as "r", and an angle 53 formed between a perpendicular line drawn from the central section 51 of the outer circumferential burner 50 to the inner surface of the combustor liner 3, and a straight line extending from the central section 51 of the outer circumferential burner 50 to that of the adjacent outer circumferential burner 50, as $\alpha$. A starting position of the angle is taken on the perpendicular line from the central section 51 of the outer circumferential burner 50 to the inner surface of the combustor liner 3, increases of the angle are defined in a direction tracing the swirling direction (in the present embodiment, clockwise), and the angle is expressed using a unit in which a full circle takes an angle of 360°. Furthermore, the swirling angle to be given to the third air blowhole array is defined as $\theta°$. Moreover, the inward inclination angle to be given to the third air blowhole array is defined as $\phi°$. The inward inclination angle is taken as an angle defined in the following expression with a difference $\Delta$ between a radius of an entrance (fuel nozzle side) of the air blowholes 21 and a radius of an exit (combustion chamber side) of the air blowholes 21, and a thickness "t" of the air blowhole plate 20:

$$\phi = \tan^{-1}\left(\frac{\Delta}{t}\right) \qquad \text{Expression (3)}$$

Besides, take a diameter of the air blowholes of the third array, as "d".

A phase angle $\psi$1 at which the mixture jetting from the air blowholes reaches the combustor wall surface for the first time can be approximated using the following expression:

$$\psi_1 \approx \frac{\theta}{(0.035\theta + 0.25)} \times \left[ -3.70\left\{\frac{L_1 - \frac{d}{2}}{r}\right\}^2 + 12.1\left\{\frac{\left(L_1 - \frac{d}{2}\right)}{r}\right\} - 7.81\right] \times \frac{\phi}{\{(0.020 \times \theta - 0.057)\phi - (0.026 \times \theta - 1.60)\}} \qquad \text{Expression (4)}$$

Also, a phase angle $\psi_2$ that the mixture jetting from the air blowholes interferes with a mixture jetting from an adjacent burner can be approximated using the following expression:

$$\psi_2 \approx \alpha + \frac{\theta}{(0.035\theta + 0.25)} \times \left[ -3.70\left\{\frac{(L_2 + d)}{2r}\right\}^2 + 12.1\left\{\frac{(L_2 + d)}{2r}\right\} - 7.81\right] \times \frac{\phi}{\{(0.020 \times \theta - 0.057)\phi - (0.026 \times \theta - 1.60)\}} \qquad \text{Expression (5)}$$

A phase region equivalent to the phase angles ranging between the $\psi_1$ and $\psi_2$ values obtained using above expressions (4) and (5) can be defined as the interference avoidance section 54. Depending upon the number of air blowholes and/or a pitch of the angles, the interference avoidance section 54 may have its starting position $\psi_1$ and ending position $\psi_2$ slightly shifted. The effects obtained, however, will be substantially the same.

When an existing combustor has an air blowhole plate shaped like a flat plate, the effects of the present embodiment can likewise be obtained by replacing the particular air blowhole plate with that of the embodiment.

Figure 9:
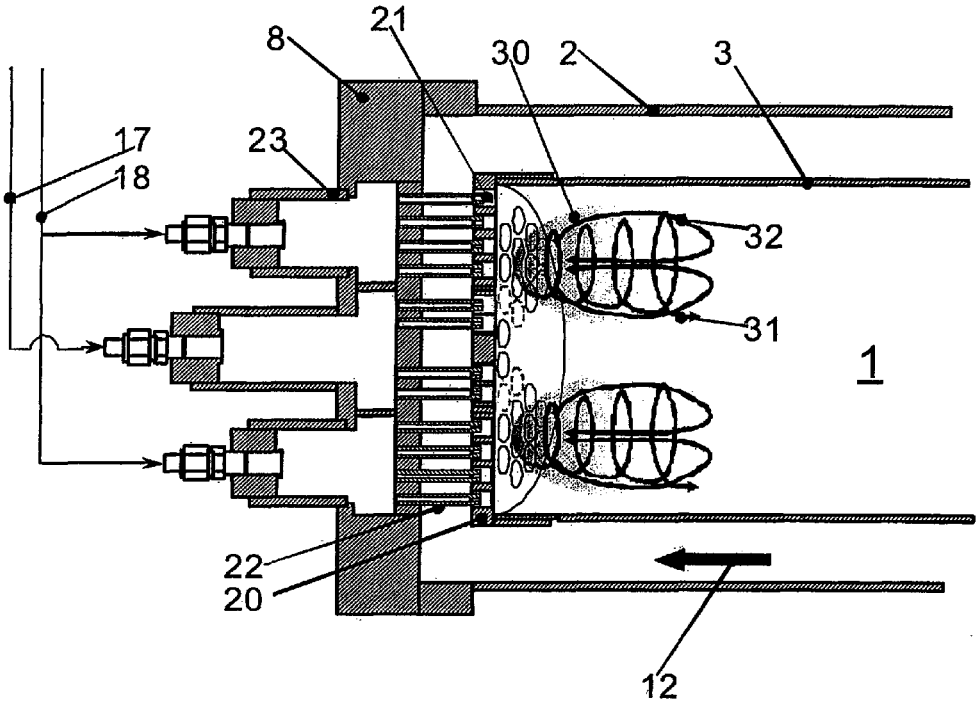
FIG. 9 is a diagram that shows an example in which, for each burner, a fuel nozzle has its front end disposed inside an air blowhole.

FIG. 9 shows an example in which, for each burner, a fuel nozzle 22 has its front end disposed inside an air blowhole 21. While an example of providing the front end of the fuel nozzle 22 at an upstream position relative to the air blowhole plate 20 has been shown in the above embodiments, the front end of the fuel nozzle 22 may be positioned inside the air blowhole plate 20, as shown in FIG. 9. Further alternatively, the front end of the fuel nozzle 22 may be positioned downstream relative to the air blowhole plate 20. In particular, to use a hydrogen-containing fuel, which is of a high combustion rate, a degree of fuel-air mixing can be appropriately set by adopting such disposition as in FIG. 9.

Figure 10:
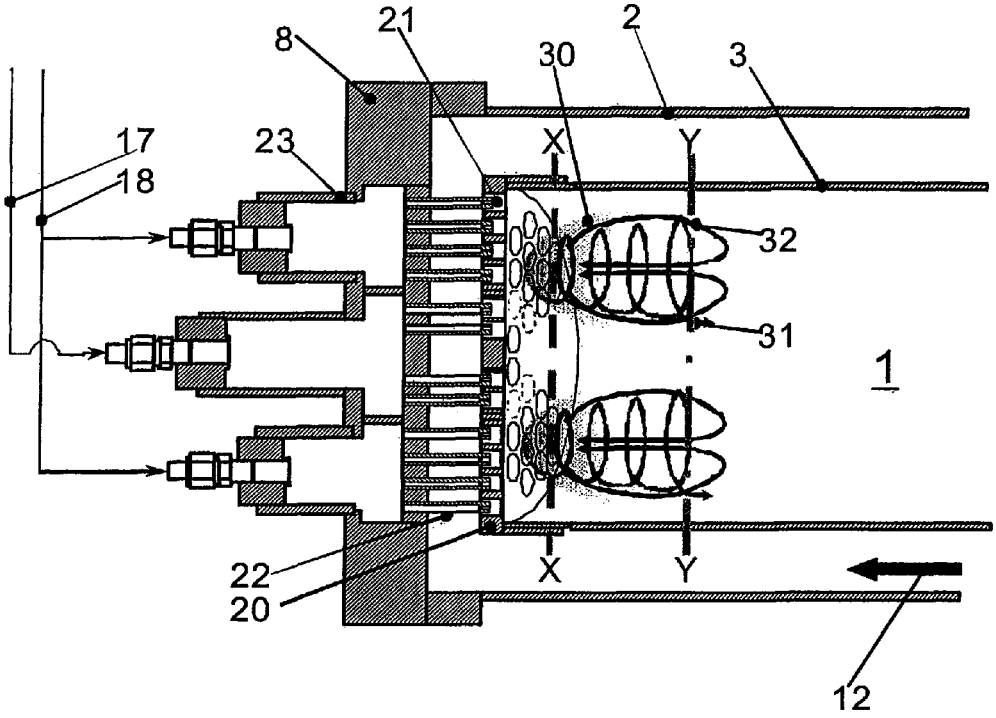
FIG. 10 is a diagram that shows a combustor axial position at which the flames of the outer circumferential burners in the combustor abut each other, and an axial position in a cross section where the flames of the outer circumferential burners abut the combustor liner.
Figure 11:
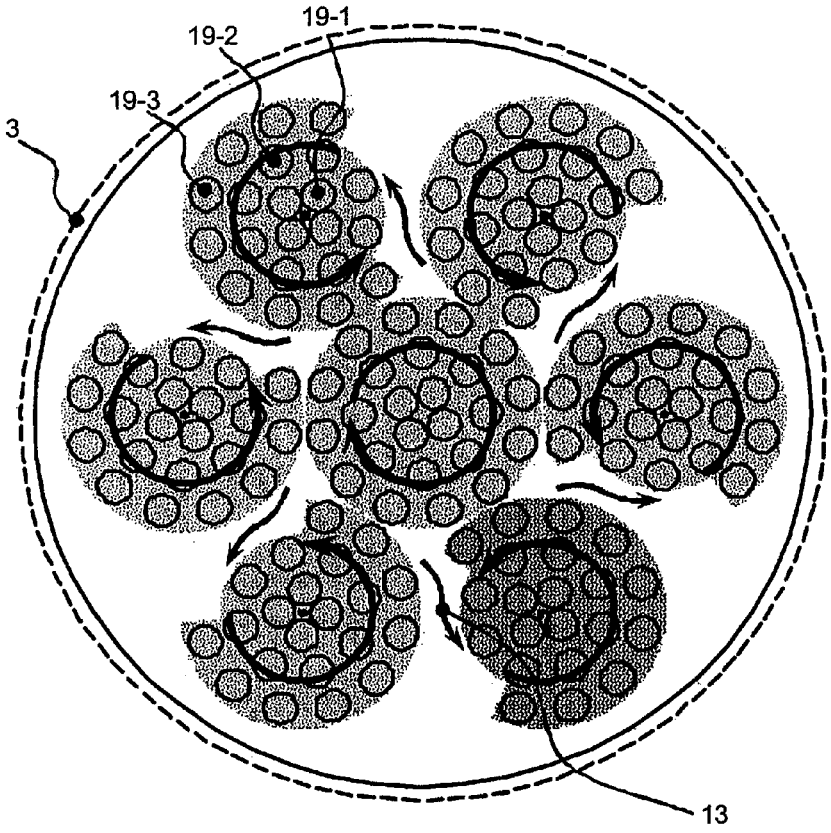
FIG. 11 is a diagram that shows cross-sectional positions of mixture jet flows at the combustor axial position where the flames of the outer circumferential burners in the combustor abut each other.
Figure 12:
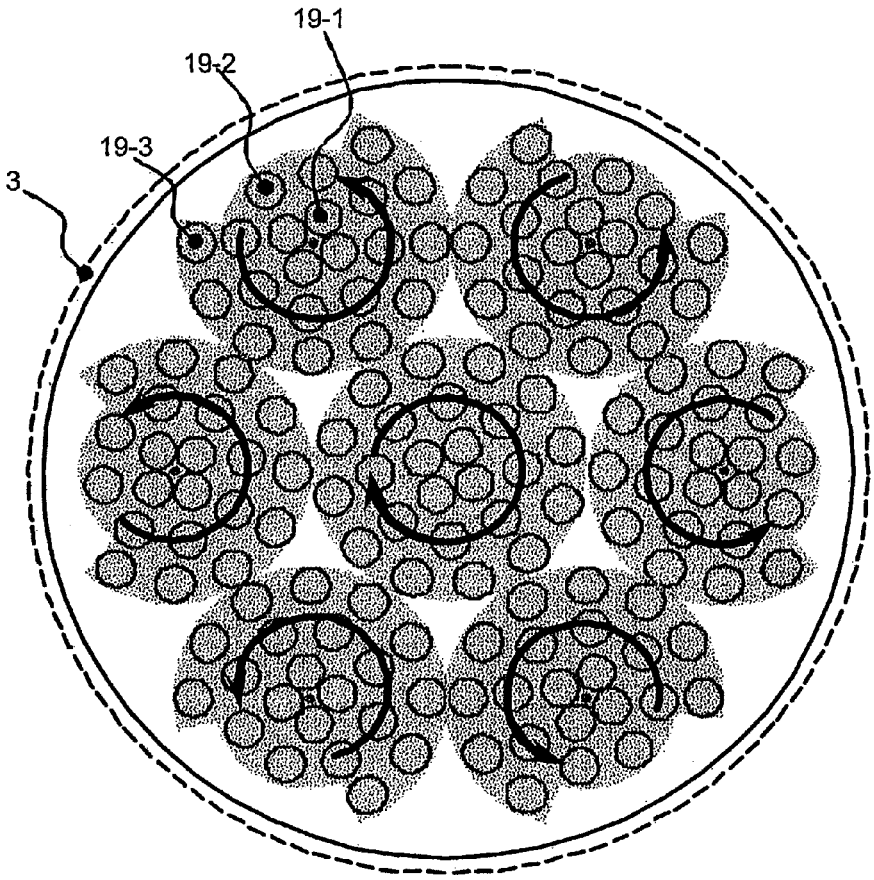
FIG. 12 is a diagram that shows cross-sectional positions of mixture jet flows at an axial position of the combustor where the flames of the outer circumferential burners in the combustor abut the combustor liner.

FIG. 10 is a diagram that shows a combustor axial position at which the flames of the outer circumferential burners in the combustor abut each other, and an axial position in a cross section where the flames of the outer circumferential burners abut the combustor liner. FIG. 11 shows cross-sectional positions of mixture jet flows at the combustor axial position where the flames of the outer circumferential burners in the combustor abut each other. FIG. 12 shows cross-sectional positions of mixture jet flows at an axial position of the combustor where the flames of the outer circumferential burners in the combustor abut the combustor liner. Circular arrows in each of the figures signify swirling directions of the mixtures 19 in the corresponding axial position, and masked regions surrounding the arrows denote a range in which the particular mixture 19 exists at the axial position. The arrows are not complete circles, having a missing section. The interference avoidance section 54 where neither an air blowhole nor a fuel nozzle 22 is disposed is equivalent to the missing section. The fuel-air mixture 19 is not jetted from the interference avoidance section 54. Therefore, this section becomes a missing portion of the mixture 19.

The air blowholes 21 in the embodiments are assigned a swirling angle, and the mixture 19 is supplied to the combustion chamber 1 while rotating as a swirling flow. This means that as the mixture 19 flows towards the downstream side, the missing portion of the mixture 19 continues to exist while changing its phase. It is one of main features of the combustor of each embodiment that the interference avoidance section 54 is provided on the air blowhole plate 20 in order to effectively dispose the missing portion of the mixture 19.

Any one of the combustors in the above-described embodiments provides two significant effects. One is that damage to the combustor liner 3 due to heat can be reduced. This can be accomplished by suppressing an approach of the flame to the combustor liner 3. The other is that the pressure fluctuations arising from the fact that a relative velocity of the swirling flow jetted from an adjacent burner is great can be suppressed.

The above embodiments relate to a combustor including the plurality of fuel nozzles 22 that jet a fuel, and the air blowhole plate 20 with the plurality of air blowhole groups each including the air blowholes 21 arranged along each of a plurality of circles to supply to the combustion chamber 1 the fuel and air jetted from each fuel nozzle 22. The air blowholes 21 in the combustor are each assigned a swirling angle to form a swirling flow that rotates about a central portion of the circle in association with each air blowhole group.

Such a combustor can be taken as a combination of a plurality of burners. That is to say, the air blowhole plate 20 shown in FIGS. 1A and 1B include seven units of air blowhole groups arranged with three air blowhole arrays each sharing the same center and taken as one air blowhole group. Let a combination of one air blowhole group and one fuel nozzle 22 that supplies the fuel to the air blowhole group, be defined as one burner unit. The combustor in each embodiment can then be described as a combination of seven burners containing one pilot burner 40 and six outer circumferential burners 50.

In the combustor of each embodiment, a first center that forms a central section of the pilot burner 40 is surrounded with a plurality of second centers that each form a central section of each outer circumferential burner 50. The combustor is further constructed so that a swirling flow formed by a first air blowhole group disposed around the first center, and a swirling flow formed by a second air blowhole group disposed around the second center will rotate in directions opposite to each other. In other words, the swirling flow jetted from the pilot burner 40, and the swirling flow jetted from at least one of the outer circumferential burners 50 will rotate in mutually opposite directions. In the region that the oppositely swirling flows each jetted from each of adjacent burners will approach, both flows are oriented in substantially the same direction and the difference in relative velocity between both becomes small. The result is that the occurrence of pressure fluctuations due to the swirling flow from the adjacent burner can be suppressed.

In the combustor of each embodiment, adjacent air blowholes arranged along the outermost circle of the first air blowhole group disposed around the central section of the pilot burner 40 are pitched at equal intervals. In addition, not all adjacent air blowholes 21-3 arranged along the outermost circle of the second air blowhole group disposed around the central section of each outer circumferential burner 50 are equally pitched. In the combustor of each embodiment, all air blowholes 21-3, except for the corresponding section, are provided at equal intervals. This section that includes no air blowhole 21-3 is equivalent to the interference avoidance section 54.

Such a region without an air blowhole 21-3 is provided to minimize damage to the combustion chamber wall due to a combustion gas created from the fuel and air supplied from the air blowholes of the second air blowhole group, that is, from the fluids jetted from the outer circumferential burner 50. The approach of a flame to the combustor liner 3 can therefore be suppressed.

A flame with on-going combustion reactions contains unstable compounds such as a $C_2$ radical and CH radical, as reaction intermediate products, and is in the process of changing the compounds into stable ones such as carbon dioxide and water vapors. Upon approaching the combustion chamber wall, the flame under such a state oxidizes the reaction intermediate products by utilizing a part of the cooling air supplied for thermal protection of the combustion chamber, and releases reaction heat. In addition to causing heat in immediate vicinity of the wall surface, the release of the reaction heat decays the cooling air flow that protects the wall surface, and leads to locally abrupt increases in wall surface temperature. The flame in such a state as containing plenty of the reaction intermediate products mentioned above can be prevented from approaching the combustion chamber wall, by avoiding the layout of air blowholes at the positions where the flame reaches the wall surface within a completion time of the combustion reactions. It is one of major features of each embodiment, therefore, that mutual interference between the combustion chamber wall surface and the flame is avoided.

Highly reliable management of the combustor becomes possible by restraining the fluids jetted from the outer circumferential burners 50, that is, the fluids supplied from the air blowholes of the second air blowhole group, from an arrival at a neighboring region of the combustion chamber wall, and speaking more accurately, within a quenching distance of the combustion chamber wall, before the fluids complete a combustion reaction.

The quenching distance means a distance within which, when the flame approaches the wall surface, the flame is extinguished by an influence of a heat capacity of the wall. In other words, the flame can gain access to the combustion chamber wall surface until the quenching distance has been reached. The quenching distance depends upon combustibility of the fuel, and is 2 mm for a natural gas that is relatively low in combustion rate, or nearly 0.4 mm for a hydrogen-rich fuel that is high in combustion rate. This means that using a hydrogen-rich fuel results in a flame causing more serious thermal damage to the combustor liner 3.

In the combustor of each embodiment, more specifically, for the plurality of air blowholes 21-3 arranged along the outermost circle of the second air blowhole group, a region without an air blowhole 21-3 can have a starting point lying within a range of 10 to 35 degrees, and an ending point lying within a range of 60 to 85 degrees. These angles are counted on the following basis. That is to say, of a straight line extending from a central section of the pilot burner 40 as a first center, to a central section of one outer circumferential burner 50 as a second center, the portion that extends from the second center, in a direction opposite to that of the first center, is used as a reference. For example, the line shown as 61 in FIG. 1A is equivalent to the reference. Angles are counted in the direction opposite to the rotating direction of the swirling flow formed by the second air blowhole group.

Figure 13:
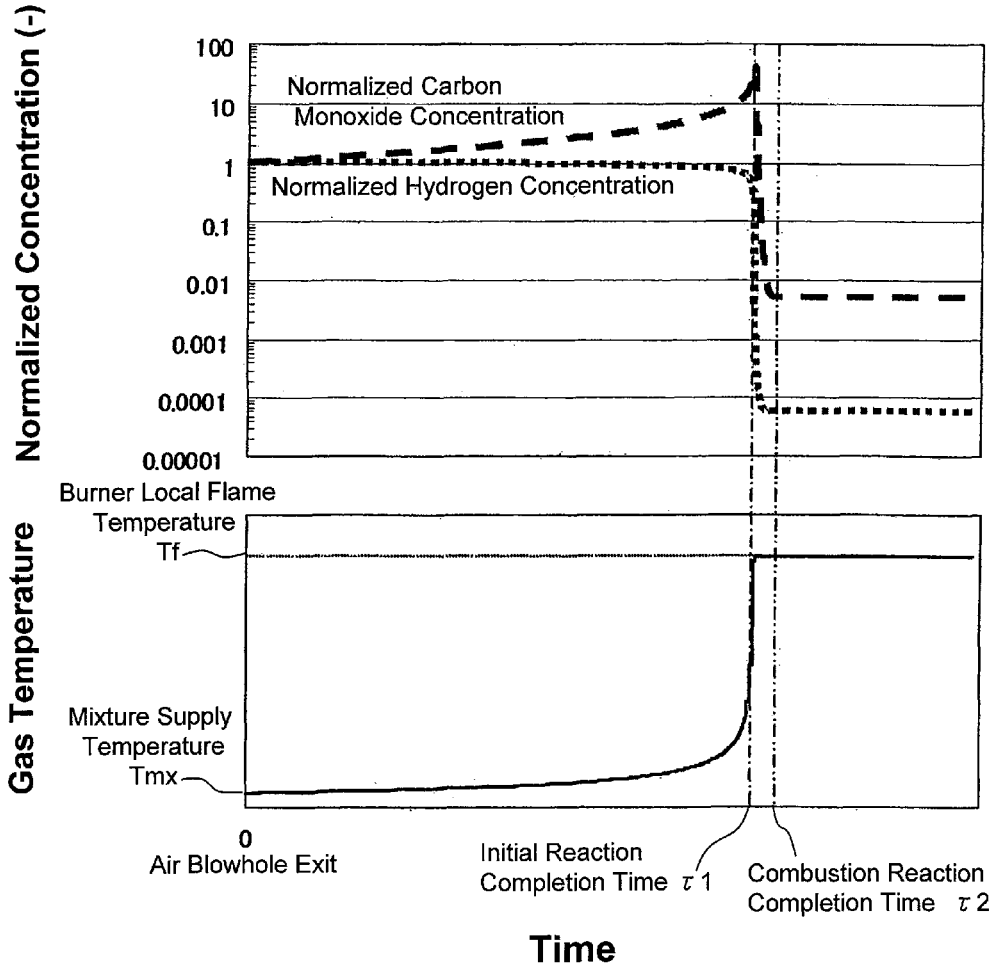
FIG. 13 is a diagram that shows how the combustion reactions in the combustor illustrated in an embodiment when a coke oven gas that is a typical hydrogen-rich fuel is used as a fuel, will progress chronologically after jetting of fluids from the air blowout exits.

FIG. 13 shows how the combustion reactions in the combustor illustrated in an embodiment when a coke oven gas that is a typical hydrogen-rich fuel is used as a fuel, will progress chronologically after jetting of fluids from the air blowout exits. The coke oven gas is a fuel that has a hydrogen content of about 55%, a carbon monoxide content of about 10%, a methane content of about 25%, and an inert component content of nearly 10%, the inert component content being inclusive mainly of nitrogen. How the hydrogen and carbon monoxide supplied as the fuel will be consumed while gas temperature increases from a temperature $\tau_{mx}$ of a mixture 19 supplied to the combustor to a frame temperature $\tau_f$ at a local of burner is shown in FIG. 13. The consumption when standardized with concentrations of the hydrogen and carbon monoxide supplied from the air blowhole exits is shown with a dotted line for the hydrogen and a broken line for the carbon monoxide.

The mixture 19, after being jetted into the combustion chamber 1, gradually rises in temperature while causing reaction intermediate products by pyrolysis of the methane and the like. After thorough progress of the pyrolysis, the mixture further generates heat rapidly while oxidizing the reaction intermediate products, to further increase the gas temperature. The carbon monoxide is a part of the fuel components, but is also an intermediate product of the pyrolytic reactions of the methane, so the carbon monoxide is suitable for use as an index for observing the progress of the reactions occurring during the particular time. That is to say, a time period from the jetting of the mixture from the air blowholes to an initial reaction completion time $\tau_1$ shown in FIG. 13 is a period during which the reaction intermediate products are generated mainly by pyrolysis of fuel, and the generation of heat during this time period is sluggish. A time period from the initial reaction completion time $\tau_1$ to a combustion reaction completion time $\tau_2$ shown in FIG. 13 is a period during which the generated unstable reaction intermediate products are rapidly oxidized to further generate a large amount of heat.

If the interference that exerts an excessive difference in velocity occurs during the time period up to the initial reaction completion time $\tau_1$, since only the sluggish generation of heat is occurring, conditions in which reactions can not be maintained are produced, resulting in a possibility of combustion instability occurring with pressure fluctuations. Additionally, if the flame enters the vicinity of the combustion chamber wall during the time period up to the initial reaction completion time $\tau_1$, the combustion chamber wall is liable to deprive the flame of the reaction heat, and thereby preventing smooth combustion reactions from progressing. If the flame enters the vicinity of the combustion chamber wall during the time period from the initial reaction completion time $\tau_1$ to the combustion reaction completion time $\tau_2$, the flame will oxidize the reaction intermediate products by utilizing a part of the cooling air supplied for thermal protection of the combustion chamber, and release the reaction heat. In addition to causing heat in the immediate vicinity of the wall surface, the release of the reaction heat will decay the cooling air flow that protects the wall surface, and lead to locally abrupt increases in wall surface temperature. During the time period up to the initial reaction completion time $\tau_1$, therefore, avoiding interference is required between fluids having a velocity component of the same swirling direction, from adjacent burners. In addition, during the time period up to the combustion reaction completion time $\tau_2$, avoiding the arrival of the flame at the combustion chamber wall is required.

Figure 14:
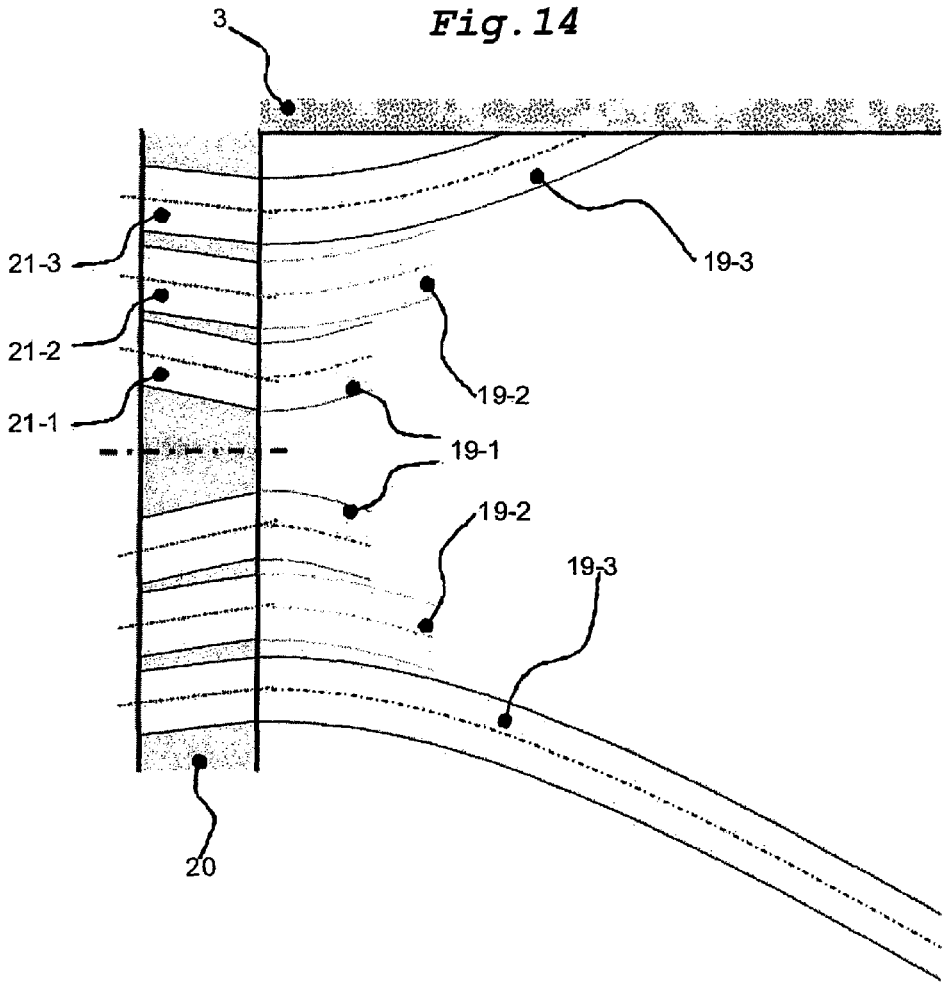
FIG. 14 is a diagram that shows jetting paths of the mixture jetted from the air blowhole plate shown in an embodiment, in the combustion chamber.

FIG. 14 shows jetting paths of the mixture jetted from the air blowhole plate 20 shown in an embodiment, in the combustion chamber. These paths (flow lines) can be derived by calculating, for each axial direction position, the distance from the burner center 51 to the air blowhole central axis, from the swirling angle θ to be assigned the air blowholes, and the radius "r" of the air blowhole pitch circle. As shown in FIG. 14, the jet flow paths of the mixture will reach the vicinity of the wall surface of the combustor liner 3 as the paths advance by a certain extent from the air blowholes, in the axial direction. Local high-temperature regions will occur in or on the combustor liner 3 if any air blowholes are opened at such a position that a value obtained by dividing the distance to the position at which the jet flows reach the vicinity of the wall surface of the combustor liner 3, by a jetting velocity of the mixture, becomes smaller than the combustion reaction completion time $\tau_2$.

Figure 15:
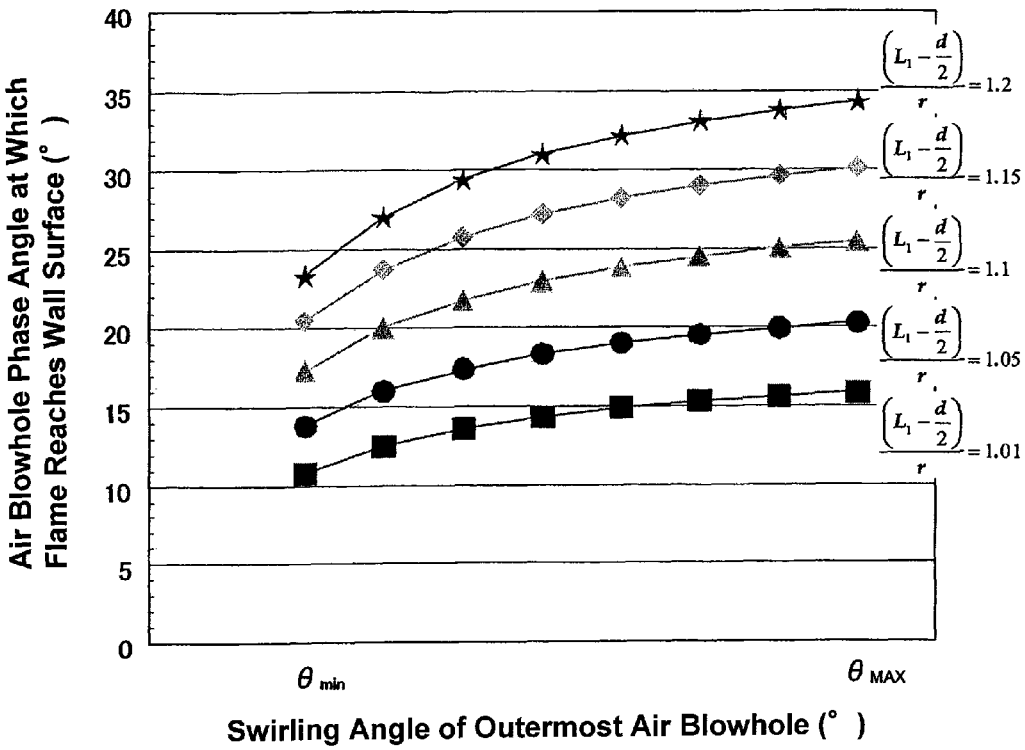
FIG. 15 is a diagram that represents a relationship between an air blowhole opening phase angle that the mixture first reaches the wall of the combustor liner, and the swirling angle assigned to the outermost air blowholes.
Figure 16:
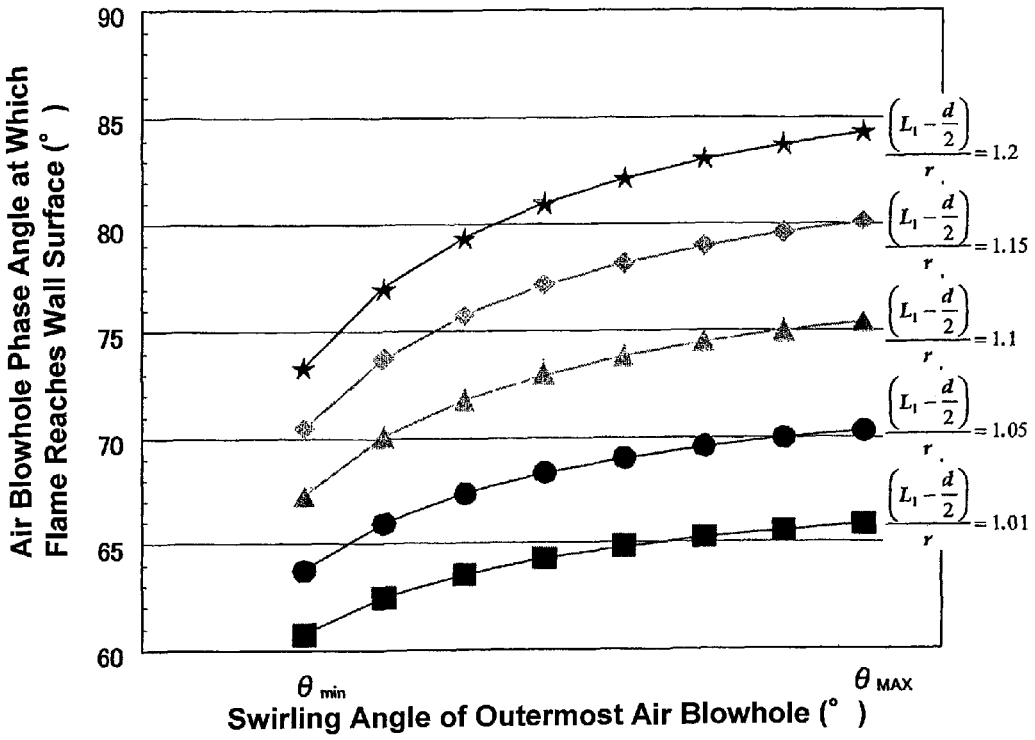
FIG. 16 is a diagram that represents a relationship between an air blowhole opening phase angle that the mixture reaches the wall of the combustor liner exactly at the combustion reaction completion time, and the outermost air blowhole swirling angle.

FIG. 15 represents a relationship between an air blowhole opening phase angle $\psi_1$ that the mixture first reaches the wall of the combustor liner 3, and the swirling angle assigned to the outermost air blowholes. A plurality of lines exist in FIG. 15 because both the distance L1 from the central section of one outer circumferential burner 50 that is the second center, to the wall surface of the combustor liner 3, and the pitch circle radius "r" of the outermost air blowholes differ according to particular specifications of the combustor. Similarly to FIG. 15, FIG. 16 represents a relationship between an air blowhole opening phase angle $\psi'_1$ that the mixture reaches the wall of the combustor liner 3 exactly at the combustion reaction completion time $\tau_2$, and the outermost air blowhole swirling angle. Strictly, the relationships between these phase angles form a complicated, trigonometric equation. For industrial purposes, however, the air blowhole opening phase angle $\psi_1$ that the mixture first reaches the wall of the combustor liner 3 can be approximated by using expression (1).

In the combustor of each embodiment, a region without an air blowhole 21-3 is set also to restrain the fluid from one outer circumferential burner 50, supplied from the air blowholes of the second air blowhole group, from interfering with the fluid supplied from another outer circumferential burner 50 or the pilot burner 40. Use of the combustor including such an air blowhole plate allows the suppression of interference between the swirling flows jetted from adjacent burners, and hence the suppression of the pressure fluctuations arising from the significant difference in relative velocity between the swirling flows. Additionally, the pressure fluctuation suppression effect can be enhanced when flow rates or other factors of the fuel(s) supplied to adjacent burners are controlled for suppressed interference between the swirling flows from the respective burners.

More specifically, for the plurality of air blowholes 21-3 arranged along the outermost circle of the second air blowhole group, a region without an air blowhole 21-3 can have a starting point lying within a range of 10 to 35 degrees, and an ending point lying within a range of 60 to 85 degrees. These angles are counted using, as a reference, the straight line connecting the central sections of adjacent burners that are second centers. In that case, the angles are counted in the direction opposite to the rotating direction of the swirling flow formed by the second air blowhole group.

A region not including an air blowhole 21-3 in order to restrain the fluid from one outer circumferential burner 50, supplied from the air blowholes of the second air blowhole group, from interfering with the fluid supplied from another outer circumferential burner 50, can be identified using substantially the same method as a method of identifying a region not including an air blowhole 21-3 in order to avoid interference between the combustor liner 3 and the flame. More specifically, an axial direction position at which the path of the jet flow jetted from the outermost air blowholes opened at a phase angle position will reach a boundary interface relative to an adjacent outer circumferential burner 50 is geometrically calculated, then a time when the calculated axial direction position will be reached is calculated from the jetting velocity of the mixture 19, and if the calculated time is earlier than the initial reaction completion time $\tau_1$, or in a more conservatively considered state, the combustion reaction completion time $\tau_2$, the mixture jetted from the air blowholes of that phase is most likely to interfere with the mixture 19 jetted from the outermost air blowholes in the adjacent outer circumferential burner 50.

The above concept can be used to identify the region not including an air blowhole 21-3 in order to restrain the fluid from one outer circumferential burner 50, supplied from the air blowholes of the second air blowhole group, from interfering with the fluid supplied from another outer circumferential burner 50. That is to say, the path of the jet flow jetted from the outermost air blowholes is the same as the path described about the interference with the wall surface, and if the time when interference should be avoided in conservative terms is considered to be later than the combustion reaction completion time $\tau_2$, the expression for calculating the phase will be practically equal to that used for avoiding the interference with the wall surface. In addition, only the position for avoiding the interference will exist at the distance $(L_2+d)/2$ relative to the adjacent outer circumferential burner, not at the distance $(L_1-d)/2$ relative to the wall surface. Therefore, if the angle 53 formed between the perpendicular line drawn from the center 51 of the outer circumference burner 50 to the inner surface of the combustor liner 3, and the straight line extending to the central section 51 of the adjacent outer circumference burner 50, is defined as $\alpha$, then an ending point of the region not including an air blowhole 21-3 can be approximated using expression (2).

Furthermore, a region at which the above two operational effects can be obtained at the same time can be selected if the starting point and the ending point are set at the positions determined by expressions (1) and (2), respectively. Considering that a practical number of outer circumferential burners is between 4 and 8, one can see that a lies between 90 degrees and 135 degrees. Accordingly, the angle between the ending point of the zone not including an air blowhole 21-3 in order to avoid the interference of the flame with the inner wall surface of the combustor liner 3, and the starting point of the zone not including an air blowhole 21-3 in order to avoid interference between fluids from the adjacent outer circumferential burners, is only about 40 degrees, and up to two opened air blowholes can only be disposed. A jet flow flame jetted from one or two isolated air blowholes will release a large amount of heat to surrounding air flows, and may thus cause the unstable combustion that gets blown off or alternates between firing and extinction. Therefore, the unstable combustion will result if isolated air blowholes are provided in a region sandwiched between the ending point of the zone not including an air blowhole 21-3 in order to avoid the interference of the flame with the inner wall surface of the combustor liner 3, and the starting point of the zone not including an air blowhole 21-3 in order to avoid interference between fluids from the adjacent outer circumferential burners.

In the combustor of each embodiment that is based on the above concept, the adjacent air blowhole spacing of the air blowholes arranged along the outermost circle of at least one air blowhole group is set so that the burner region includes a section of a size different from the adjacent air blowhole spacing. When the pilot burner 40 includes such a section, the occurrence of the pressure fluctuations arising from interference between fluids jetted from the adjacent burners can be suppressed. When the outer circumferential burner 50 includes such a section, an approach of the flame to the combustor liner 3 can be further suppressed.

Figure 17:
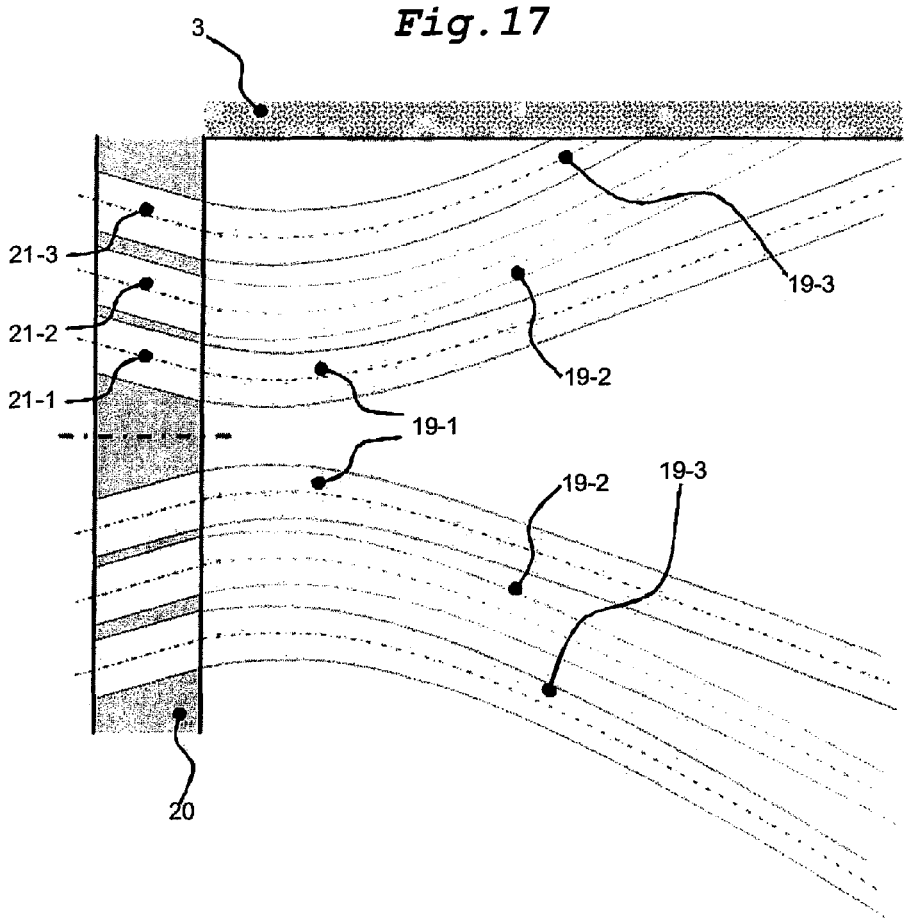
FIG. 17 is a diagram that shows jetting paths of the mixture jetted from the air blowhole plate shown in an embodiment, in the combustion chamber.

Similarly to FIG. 14, FIG. 17 shows jetting paths of the mixture jetted from the air blowhole plate 20 shown in an embodiment, in the combustion chamber. The air blowhole plate 20 in this case includes the air blowholes each having a swirling angle $\theta$ and inward inclination angle $\phi$ assigned thereto. When the swirling angle $\theta$ and the inward inclination angle $\phi$ are assigned to the air blowholes, the mixture jetted from the air blowhole plate 20 will temporarily become scaled down in swirling radius before expanding. Therefore, the axial position where the mixture reaches the boundary relative to the combustor liner wall surface or the adjacent outer circumferential burner 50 will move towards the downstream side. This will require correction that uses the inward inclination angle $\phi$ to slow down the expansion of the jet flow paths in both the zone not including an air blowhole 21-3 in order to avoid the interference of the flame with the inner wall surface of the combustor liner 3, and the starting point of the zone not including an air blowhole 21-3 in order to avoid interference between fluids from the adjacent outer circumferential burners.

A correction term considering that the axial direction position where the inward inclination angle $\phi$ scales down the swirling radius of the jet flow and the jet flow reaches the boundary to be studied for interference moves towards the downstream side, can be determined using geometric characteristics of the jet flow. Strictly, the correction term gives a complicated, trigonometric equation. For industrial purposes, however, the correction term can be approximated using expression (6).

$$\frac{\phi}{\{(0.020\times\theta-0.057)\phi-(0.026\times\theta-1.60)\}} \quad \text{Expression (6)}$$

A numerical representation derived by applying this correction term to approximate the starting point of the zone not including an air blowhole 21-3 in order to avoid the interference of the flame with the inner wall surface of the combustor liner 3 is expression (4). Likewise, a numerical representation derived by approximating the ending point of the zone not including an air blowhole 21-3 in order to avoid interference between fluids from the adjacent outer circumferential burners is expression (5). When the correction term is applied, the interference of the flame with the inner wall surface of the combustor liner 3 can be avoided in the combustor of each embodiment when the air blowholes 21-3 arranged along the outermost circle of the second air blowhole group are configured so that the starting point of the region not including an air blowhole 21-3 lies in a range of 10 to 120 degrees and so that the ending point of the region not including an air blowhole 21-3 lies in a range of 80 to 120 degrees. These angles are counted on the following basis. That is to say, of a straight line extending from a central section of the pilot burner 40 as a first center, to a central section of one outer circumferential burner 50 as a second center, only a portion that extends from the second center, in a direction opposite to that of the first center, is used as a reference.

Likewise, in a case where the above correction term is applied, interference between fluids from the adjacent outer circumferential burners can be avoided in the combustor of each embodiment when the air blowholes 21-3 arranged along the outermost circle of the second air blowhole group are configured so that the starting point of the region not including an air blowhole 21-3 lies in a range of 10 to 65 degrees and so that the ending point of the region not including an air blowhole 21-3 lies in a range of 40 to 60 degrees from the starting point of the region. These angles are counted using, as a reference, the straight line connecting the central sections of adjacent burners that are second centers. In this case, the angles are counted in the direction opposite to the rotating direction of the swirling flow formed by the second air blowhole group.

If the angle 53 formed between the perpendicular line drawn from the center 51 of the outer circumference burner 50 to the inner surface of the combustor liner 3, and the straight line extending to the central section 51 of the adjacent outer circumference burner 50, is defined as $\alpha$, then considering that a practical number of outer circumferential burners is between 4 and 8, one can see that a lies between 90 degrees and 135 degrees. Accordingly, the ending point of the zone not including an air blowhole 21-3 in order to avoid the interference of the flame with the inner wall surface of the combustor liner 3, and the ending point of the zone not including an air blowhole 21-3 in order to avoid interference between fluids from the adjacent outer circumferential burners lie in a range up to 210 degrees in the direction opposite to the swirling direction, with a reference set on such a portion of the straight line from the first center to the second center, that extends from the second center in the direction opposite to the swirling direction. In other words, for the air blowholes arranged along the outermost circle of the second air blowhole group, with the reference set on such portion of the straight line from the first center to the second center, that extends from the second center in the direction opposite to the swirling direction, a region free from air blowholes 21-3 does not need to be set at angles up to at least 150 degrees from the reference in the rotating direction of the swirling flow.

Accordingly, when the adjacent air blowhole spacing of the air blowholes 21-3 in this region is equal between the air blowholes, such a combustor can be supplied that allows the jet flow flames from individual air blowholes to appropriately join adjacent jet flow flames and assist one another to form stable propagation flames.

In the combustor of each embodiment, fuel lines of the pilot burner 40 and outer circumferential burners 50 can be operated independently. Structurally, the combustor includes a first fuel supply line that supplies a starting fuel 17 to a fuel nozzle 22 for jetting a fuel towards the combustion chamber 1 via a first air blowhole group, and a second fuel supply line that supplies an outer-circumferential burner fuel 18 to another fuel nozzle 22 for jetting another fuel towards the combustion chamber 1 via a second air blowhole group. Constructing the combustor in this form allows the gas turbine to be suitably started and at the same time, to be operated at a low NOx emission level during loaded operation. In addition, the combustor can have an ability to provide optimal control for minimum thermal load upon the combustor liner 3 and suppressed interference of the swirling flows from adjacent burners.

Providing the interference avoidance section 54 in the outer circumferential burners 50 yields the following subsidiary effects. That is to say, the presence of the interference avoidance section 54 in each outer circumferential burner 50 creates a missing portion of the mixture. The mixture, after being jetted from the outer circumferential burner 50, consequently flows towards the downstream side while inclining to the missing portion side of the mixture. That is to say, the same effect can be obtained for the mixtures jetted from each outer circumferential burner 50 as when a swirling angle is provided to an air blowhole. Accordingly, this leads to the swirling action being developed for each outer circumferential burner 50 as well as for each air blowhole 21. The result is that an effect of flame stability being even more enhanced can also be obtained.

What is claimed is:

1. A combustor comprising:

a plurality of fueling nozzles that jet a fuel; and a blowhole plate having blowholes, wherein each blowhole is configured to supply a mixture of air and the fuel jetted from each of the fueling nozzles to a combustion chamber; wherein a plurality of said blowholes are arranged in a plurality of circular arrays, wherein said circular arrays are concentric to one another and form a plurality of groups;

a center group of said plurality of groups is located at a center of the blowhole plate, surrounding groups of said plurality of groups, are arranged to form a circular array around said center group, the blowholes of said center group are provided with a swirling angle to form a first swirling flow that rotates around each circular array of said center group, wherein the first swirling flow rotates along a first direction, the blowholes of said surrounding groups are provided with a swirling angle to form a second swirling flow along a second direction, wherein said first and second directions are opposite to one another, each group of said surrounding groups comprises an outermost circular array of blowholes, and said outermost circular array of blowholes includes a region that is substantially and continuously devoid of blowholes, such that a plan view of the blowhole plate depicts said outermost circular array of blowholes being substantially c-shaped.

2. The combustor according to claim 1, wherein:

the center group is surrounded by said surrounding groups;

an adjacent blowhole spacing between blowholes arranged along the outermost circular array of blowholes of said center group is an equal spacing and;

an adjacent blowhole spacing between blowholes arranged along the outermost circular array of blowholes of one of said surrounding groups is a partly unequal spacing.

3. The combustor according to claim 1, wherein:

the outermost circular array of blowholes of one of said surrounding groups is formed so that: when, of a straight line interconnecting a first center corresponding to a center of the center group, and a second center corresponding to a center of one of the plurality of said surrounding groups, only a portion that starts from the second center and extends in a direction opposite to the first center is taken as a reference, an adjacent blowhole spacing between blowholes arranged at angles up to at least 150 degrees in said second direction is an equal spacing.

4. The combustor according to claim 1, wherein:

in order to reduce damage to a wall of the combustion chamber due to a combustion gas generated by the fuel and air supplied from the blowholes of one of the plurality of said surrounding groups, blowholes of said outermost circular array of one of the plurality of said surrounding groups are formed so as to be partly unequal in spacing.

5. The combustor according to claim 1, wherein:

a region free from said blowholes is provided in a vicinity to the blowholes of said outermost circular array of one of the plurality of said surrounding groups; and when, of a straight line interconnecting a first center corresponding to a center of the center group, and a second center corresponding to a center of one of the plurality of said surrounding groups, only a portion that starts from the second center and extends in a direction opposite to the first center is taken as a reference, in said first direction, the region has a starting point lying in an angle range between 10 degrees and 120 degrees, and has an ending point lying in an angle range between 80 degrees and 210 degrees.

6. The combustor according to claim 1, wherein:

in order to restrain a fluid supplied from the blowholes of one of the plurality of said surrounding groups, from interfering with a fluid supplied from any other of said groups, the plurality of blowholes arranged along said outermost circular array of said one of said plurality of surrounding groups are formed so as to be partly unequal in spacing.

7. The combustor according to claim 1, wherein:

a region free from said blowholes is provided in a vicinity to the blowholes of said outermost circular array of one of the plurality of said surrounding groups; and when a straight line interconnecting a center of one of the plurality of said surrounding groups and a center of an adjacent one of the plurality of said surrounding groups is taken as a reference, in said first direction, the region has a starting point lying in an angle range between 10 degrees and 65 degrees, and has an ending point lying in an angle range between 40 degrees and 60 degrees from the starting point of the region.

8. The combustor according to claim 1, wherein:

for the blowholes of said outermost circular array of one of the plurality of said surrounding groups, when, of a straight line interconnecting a first center corresponding to a center of the center group, and a second center corresponding to a center of one of the plurality of said surrounding groups, only a portion that starts from the second center and extends in a direction opposite to the first center is taken as a reference, in the first direction, no blowhole is present in a zone whose starting point is represented by expression (1) and whose ending point is represented by expression (2).

9. The combustor according to claim 1, further comprising:

a first fuel supply line that supplies a first fuel to a fueling nozzle configured to jet the fuel towards the combustion chamber via the center group; and a second fuel supply line that supplies a second fuel to another fueling nozzle configured to jet the second fuel towards the combustion chamber via the one of the plurality of said surrounding groups.

10. The combustor according to claim 1, wherein:

blowholes of one of the plurality of said surrounding groups are each provided with an inward inclination angle so as to incline inward with respect to a center of said one of the plurality of said surrounding groups.

* * * * *